US007137228B2

(12) United States Patent
Wagner

(10) Patent No.: US 7,137,228 B2
(45) Date of Patent: Nov. 21, 2006

(54) SAFETY COVER FOR POST BRACKETS, COLUMN BASE CONNECTORS, AND THE LIKE

(76) Inventor: David F. Wagner, 35825 Meadowridge Rd., Temecula, CA (US) 92592

( * ) Notice: Subject to any disclaimer, the term of this patent is extended or adjusted under 35 U.S.C. 154(b) by 0 days.

(21) Appl. No.: 09/962,049

(22) Filed: Sep. 25, 2001

(65) Prior Publication Data

US 2002/0038534 A1 Apr. 4, 2002

Related U.S. Application Data

(60) Provisional application No. 60/236,693, filed on Oct. 2, 2000.

(51) Int. Cl.
*E02D 27/32* (2006.01)

(52) U.S. Cl. ..... 52/295; 52/165; 52/170; 52/296; 52/40; 40/607.01; 248/346.01; 248/519; 248/523

(58) Field of Classification Search ..... 52/40, 52/300, 301, 165, 170, 296, 295; 40/607, 40/612, 607.01; 256/48, 1; 248/346.01, 248/519, 523, 527, 530, 357
See application file for complete search history.

(56) References Cited

U.S. PATENT DOCUMENTS 2,450,345 A * 9/1948 Kervin
3,250,050 A * 5/1966 Finger et al.
3,319,328 A * 5/1967 Finger et al.
4,199,908 A * 4/1980 Teeters ..... 52/295
4,516,756 A * 5/1985 Beatty ..... 256/1
5,606,815 A * 3/1997 Feldwhere ..... 40/607
5,636,482 A * 6/1997 Klager ..... 52/165
5,956,875 A * 9/1999 Aughenbaugh ..... 40/607
6,021,614 A * 2/2000 Krieger ..... 52/300
6,336,620 B1 * 1/2002 Belli ..... 248/519

OTHER PUBLICATIONS

Page 36 of the "Wood Construction Connectors" catalog C-2001 published by Simpson Strong-Tie Co., Inc. of Dublin, California showing connectors that are prior art relative to the instant application.

* cited by examiner

*Primary Examiner*—Carl D. Friedman
*Assistant Examiner*—Yvonne M. Horton
(74) *Attorney, Agent, or Firm*—Mary Jo Redman; Calif Tervo; Palomar Patent

(57) ABSTRACT

A protective cover for a column base connector having a lower portion set in a body of concrete and an upper portion in the form of spaced-apart, upstanding, first and second flanges extending upwardly from an upper surface of the body of concrete, each one of the first and second flanges defining a respective one of first and second flange bolt holes for use in bolting a column to the column base connector. The protective cover takes the form of an inverted pot having a lower edge and a size such that the inverted pot fits over the upper portion of the column base connector with the lower edge atop an upper surface of the body of concrete. The inverted pot includes a first side that defines a first cover bolt hole disposed in a position to align with the first flange bolt hole, and a second side of the inverted pot opposite the first side that defines a second cover bolt hole disposed in a position to align with the second flange bolt hole. In one embodiment, the inverted pot is shaped as a truncated rectangular pyramid, the first and second cover bolt holes are vertically elongated slots.

4 Claims, 4 Drawing Sheets

Fig. 1 - Prior Art

SAFETY COVER FOR POST BRACKETS, COLUMN BASE CONNECTORS, AND THE LIKE

CROSS REFERENCE TO RELATED APPLICATION

This application claims the benefit of copending U.S. Provisional Application Ser. No. 60/236,693 filed Oct. 2, 2000.

BACKGROUND OF THE INVENTION

1. Technical Field

This invention relates generally to building construction equipment, and more particularly to a protective cover for post brackets, column base connectors, and the like.

2. Description of Related Art

The term "column base connector" refers to the metal brackets that secure the base of a structural column atop a concrete slab or footing. As used herein, that term includes post brackets and any other type of connector or bracket having a lower portion that is set in a body of concrete and an upper portion in the form of two upstanding flanges that extend upwardly from an upper surface of the body of concrete. A typical column base connector, for example, is a one to two feet long component formed from 7 to 12 gauge, 2-inch wide, galvanized steel straps. It includes a six to nine inch long lower portion that is set in the concrete footing, and a six to nine inch long upper portion that includes two spaced-apart, upstanding flanges extending upwardly from the upper surface of the concrete footing. The upstanding flanges are spaced apart the width of the column to be secured (e.g., typically 3 9/16 inches for 4×4 and 4×6 wooden columns and 5½ inches for a 6×6 wooden column). The column is bolted in place with bolts that extend through bolt holes in the upstanding flanges and aligned bolt holes drilled through the column.

This type of construction is commonly employed for decks, patio covers, and any of various other building structures using posts or columns. The problem is that there is typically a substantial period of time between the time the concrete crew pours the concrete and sets the column base connectors and the time the carpenters bolt the columns in place. During this period, the upstanding flanges are dangerous projections that can cause lacerations and even impalement. The potential for injury is very real and serious, and so a need exists for a way to overcome this concern.

SUMMARY OF THE INVENTION

This invention alleviates the concerns outlined above by providing a protective cover for the column base connectors. The cover fits over, and is secured onto, the upstanding flanges. The cover prevents lacerations and impalement, it is easily removed when it is time to mount the columns, and it is re-useable thereafter.

To paraphrase some of the more precise language appearing in the claims, a protective cover constructed according to the invention is intended for use with a column base connector having a lower portion set in a body of concrete and an upper portion in the form of spaced-apart, upstanding, first and second flanges extending upwardly from an upper surface of the body of concrete, each one of the first and second flanges defining a respective one of first and second flange bolt holes for use in bolting a column to the column base connector. The protective cover includes an inverted pot having a lower edge and a size such that the inverted pot fits over the upper portion of the column base connector with the lower edge atop an upper surface of the body of concrete. A first side of the inverted pot defines a first cover bolt hole disposed in a position to align with the first flange bolt hole. A second side of the inverted pot disposed opposite the first side defines a second cover bolt hole disposed in a position to align with the second flange bolt hole.

One preferred embodiment is in the shape of a truncated rectangular pyramid and is rectangular in horzontal cross-section. It is fabricated of tough, impact-resistant plastic, such as ABS, to be at least 8.5 inches high in order to cover most sizes of column base connectors, and no more than 12 inches high in order to limit silhouette height and fabrication cost.

Thus, the invention provides a re-useable protective cover that is conveniently installed to help avoid injury from column base connectors. The following illustrative drawings and detailed description make the foregoing and other objects, features, and advantages of the invention more apparent.

DESCRIPTION OF THE PREFERRED EMBODIMENTS

Figure 1:
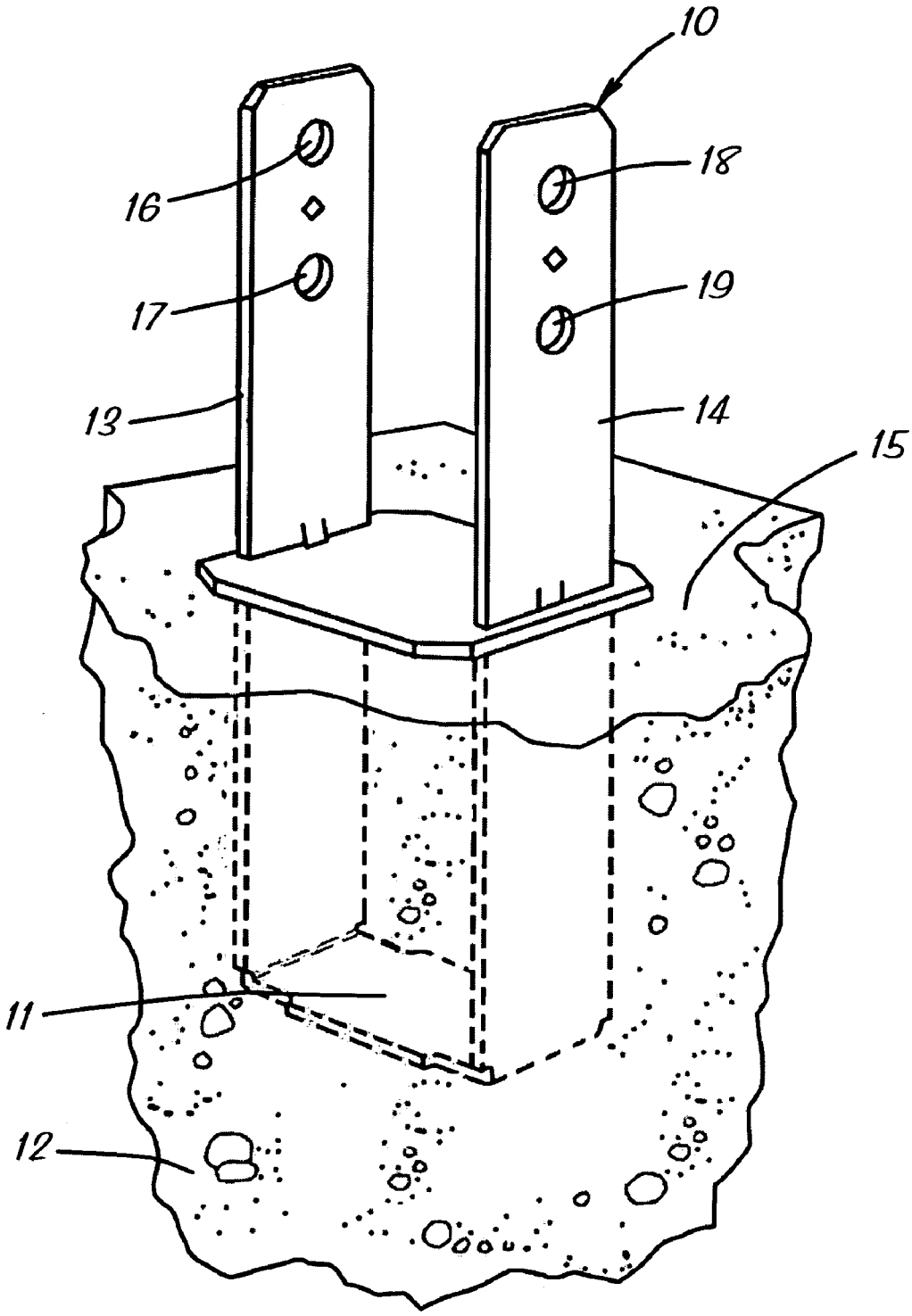
FIG. 1 of the drawings is an isometric view of a prior art column base connector set in a body of concrete.

FIG. 1 of the drawings shows a column base connector 10 constructed according to the prior art. It includes a lower portion 11 set in a body of concrete 12, and an upper portion in the form of two spaced-apart, upstanding, first and second flanges 13 and 14. The first and second flanges extend upwardly from an upper surface 15 of the body of concrete 12, and they are spaced apart a distance sufficient to receive the base of a structural column between them. The column base connector 10 represents any of various types, kinds, and sizes of column base connectors. It is illustrated arbitrarily as a column base connector for a 4×6 wooden column or post (not shown), using 12-gauge,2-inch wide galvanized steel straps such that the lower portion extends downwardly into the body of concrete about 8 inches, the first and second flanges 13 and 14 extend upwardly from the upper surface 15 about 7.5 inches, and the first and second flanges 13 and 14 are paced apart about 3 9/16 inches. The first flange 13 defines first and third flange bolt holes 16 and 17, and the second flange 14 defines second and fourth flange bolt holes 18 and 19 (e.g., for receiving ½-inch diameter bolts). Of course, those particulars may vary significantly according to the precise column base connector 10 set used.

With the column base connector 10 set in the body of concrete 12 as illustrated, carpenters eventually bolt a column (not shown) in place atop the body of concrete 12 using bolts that extend through the flange bolt holes 16–19 and aligned bolt holes drilled through the column (as used herein, the term "column" includes posts). Until the carpenters do so, however, the upstanding first and second flanges 13 and 14 are dangerous projections that can cause lacerations and even impalement as mentioned previously.

Figure 2:
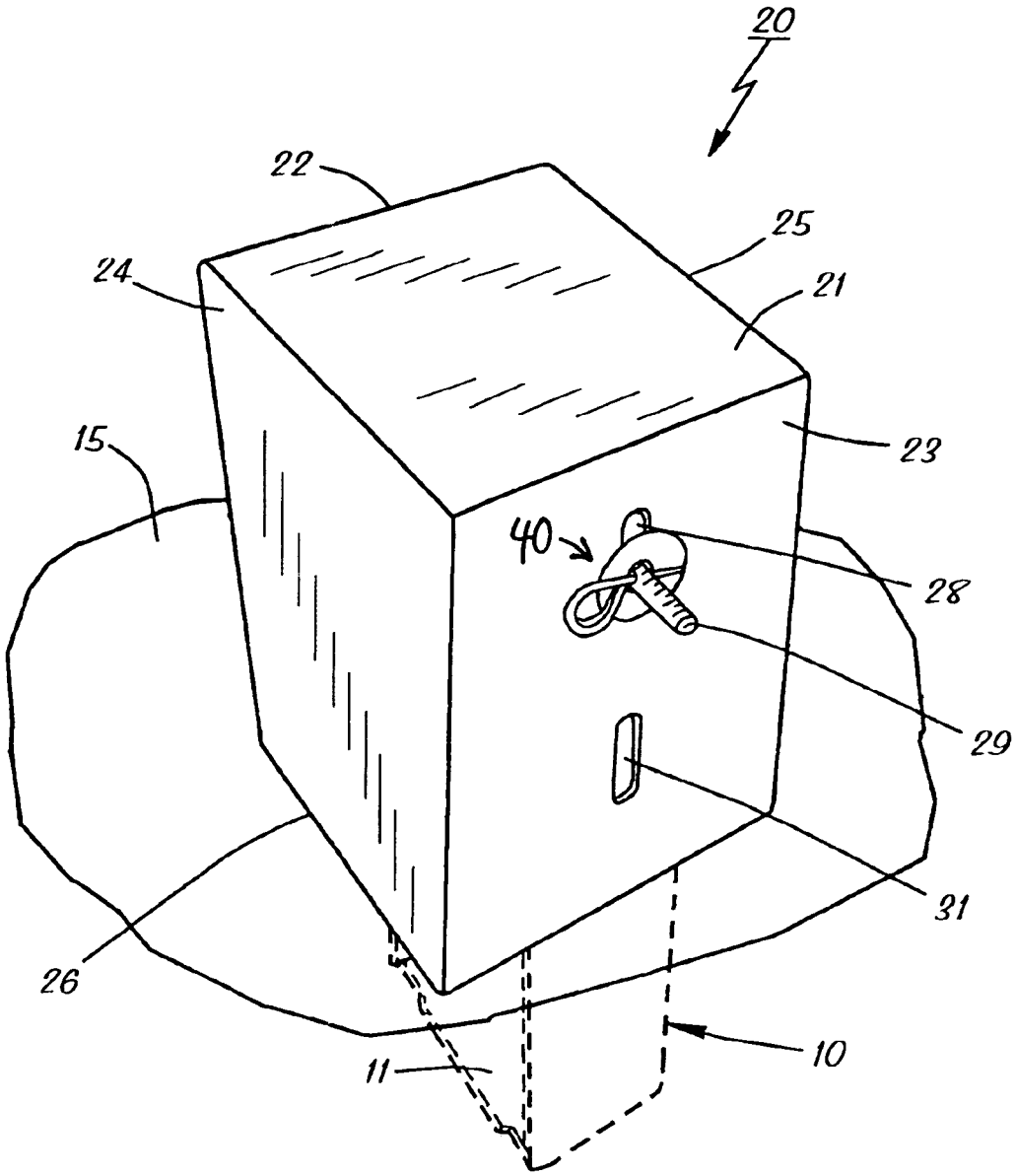
FIG. 2 is a perspective view of a protective cover constructed according to the invention, shown resting atop an upper surface of the body of concrete in a position covering the column base connector.

FIG. 2 shows a protective cover in the form of an inverted pot 20 constructed according to the invention and installed over the column base connector 10. It is in an inverted pot in the sense that it has a shape resembling a normally upwardly opening vessel or container having a bottom and an upper rim that has been turned upside down so that it is downwardly opening with its rim facing downwardly and its bottom facing upwardly. Inverted that way, the rim is then a lower edge and the bottom is a top.

The inverted pot 20 includes a top 21, first and second sides 22 and 23, and a lower edge 26. The sides 22, 23 are attached to and extend from the top 21 to the lower edge 26. A circularly shaped inverted pot may be used within the broader inventive concepts disclosed (two semi-circularly shaped sides), but the inverted pot 20 shown in the drawings is shaped as a truncated rectangular pyramid, having a rectangular top 21 measuring about 6 inches on each edge and a rectangular lower edge 26 measuring about 6.5 inches on each edge. First and second sides 22, 23 and third and fourth sides 24, 25 are about 9.75 inches long and slope slightly from the top 21 to the lower edge 26, typically providing an inch of draft along the height of each side 22–25. Pot 20 is fabricated of suitably rigid and strong material and dimensioned to be at least 8.5 inches high in order to cover most sizes of column base connectors, and no more than 12 inches high in order to limit silhouette height (less obtrusive) and fabrication cost.

Figure 3:
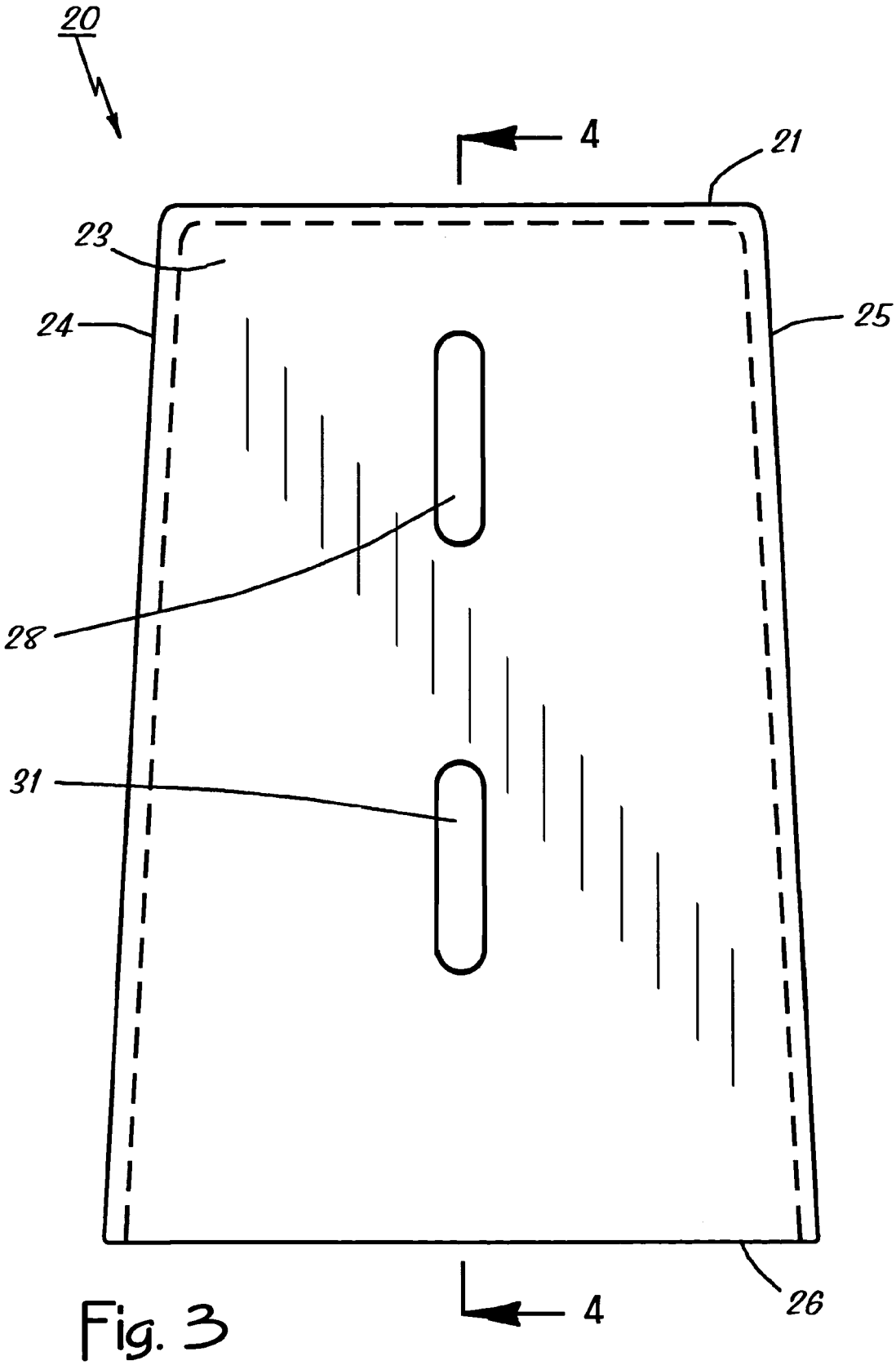
FIG. 3 is an elevation view showing a first side of the cover.
Figure 4:
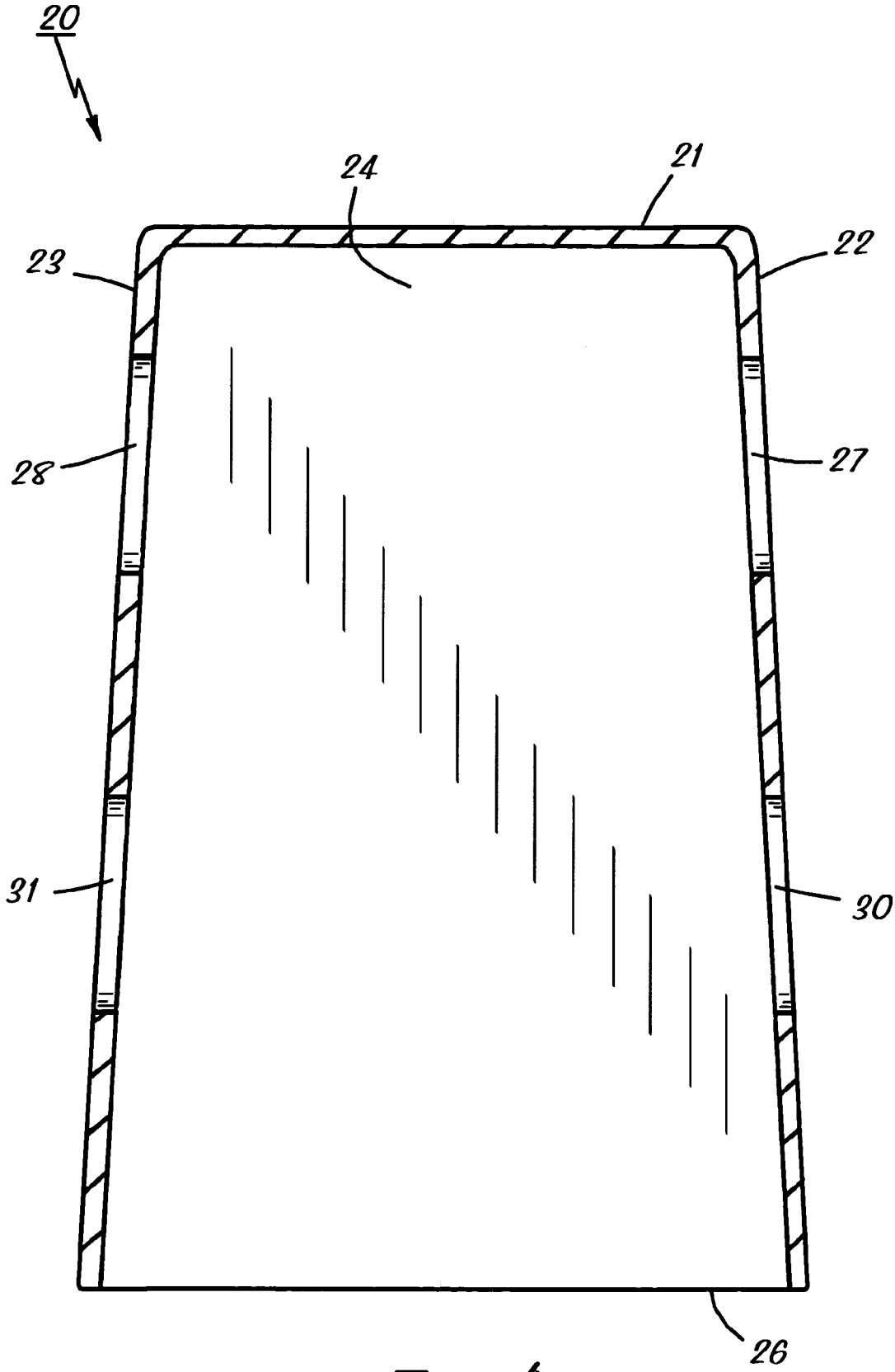
FIG. 4 is a cross sectional view of the cover as viewed in a plane containing a line 4—4 in FIG. 3 that passes perpendicularly through the first side of the cover.

The first side 22 defines a first cover bolt hole 27, and the second side 23 defines a second cover bolt hole 28 (FIGS. 2–4). The inverted pot 20 is secured to the column base connector 10, such as by bolt 29 that extends through the first and second cover bolt holes 27 and 28 and the first and second flange bolt holes 16 and 18. As used herein, the term "bolt" includes any sort of bolt, pin, or rod. Bolt 29 is secured by securing means 40, such as a washer and clevis pin, or a nut or other suitable arrangement.

The first side 22 also defines a third cover bolt hole 30, and the second also defines a fourth cover bolt hole 31. The extra cover bolt holes 30 and 31 facilitate use of the inverted pot 20 with different sizes of column base connectors. The cover bolt holes 27, 28, 30, and 31 are all elongated slots as illustrated (e.g., 0.5 inches wide by 2 inches long) to further help accommodate different column base connector sizes having flange bolt holes at different distances from the upper surface of the concrete footing, slab, or other body of concrete in which the column base connector is set. As a result, the inverted pot 20 has at least two cover bolt holes disposed in positions to align with two of the flange bolt holes, for any typical column base connector.

Thus, the invention provides a protective cover for the column base connectors. The cover fits over, and is secured onto, for example by a bolt secured with a nut or a pin, the upstanding flanges of the column base connector. The cover prevents lacerations and impalement, it is easily removed when it is time to mount the columns, and it is re-useable thereafter. Although an exemplary embodiment has been shown and described, one of ordinary skill in the art may make many changes, modifications, and substitutions without necessarily departing from the spirit and scope of the invention.

The invention claimed is:

1. A protective cover for a column base connector having a lower portion set in a body of concrete and an upper portion in the form of spaced-apart, upstanding, first and second flanges extending upwardly from an upper surface of the body of concrete, each one of the first and second flanges defining a respective one of first and second flange bolt holes for use in bolting a column to the column base connector, the protective cover including:

an inverted pot for covering the first and second flanges; including;

a top;

a first side extending downward from said top and defining a first cover bolt hole disposed in a position alignable with the first flange bolt hole; and further defining a third cover bolt hole;

a second side disposed opposite said first side, extending downward from said top and defining a second cover bolt hole disposed in a position alignable with the second flange bolt hole; and further defining a fourth cover bolt hole; and a lower edge opposite said top and attached to said first side and said second side, for being supported by the upper surface of the body of concrete; and a bolt for passing through said first cover bolt hole, a flange bolt hole of at least one flange, and said second cover bolt hole of said second side so as to rigidly attach said protective cover to the column base connector and maintain said lower edge in contact with the upper surface of the body of concrete and wherein: said protective cover is adapted to protect a living creature from being injured by accidental contact with the column base connector.

2. A protective cover as recited in claim 1, wherein said cover bolt holes are vertically elongated slots.

3. A protective cover as recited in claim 1, wherein said inverted pot is at least 8.5 inches high and not more than 12 inches high.

4. In combination:

a column base connector for supporting a column of a structure; including:

a lower portion set in a body of concrete having an upper surface; and an upper portion extending upwardly from the upper surface of the body of concrete; including:

a first flange; including:

a first flange bolt hole for attaching a column; and a second flange, spaced apart from and generally parallel to said first flange; including:

a second flange bolt hole for attaching a column; and a protective cover for covering said first flange and said second flange; including:

a top;

a lower edge opposite said top for being supported by the upper surface of the body of concrete;

a first sidewall attached to said top and extending downward to said lower edge; including:

a first cover bolt hole; disposed so as to be alignable with said first flange bolt hole;

a second sidewall attached to said top and extending downward to said lower edge; including:

a second cover bolt hole; disposed so as to be alignable with said second flange bolt hole; and a bolt for passing through said first cover bolt hole, a flange bolt hole of at least one flange, and said second cover bolt hole of said second side so as to rigidly attach said protective cover to the column base connector and maintain said lower edge in contact with the upper surface of the body of concrete and wherein: said protective cover is adapted to protect a living creature from being injured by accidental contact with said column base connector.

* * * * *